US007942175B2

(12) United States Patent
Suzuki

(10) Patent No.: US 7,942,175 B2
(45) Date of Patent: May 17, 2011

(54) METHOD OF PROCESSING WOODEN PIECE

(75) Inventor: Tatsuya Suzuki, Tokyo (JP)

(73) Assignee: Olympus Corporation, Tokyo (JP)

( * ) Notice: Subject to any disclaimer, the term of this patent is extended or adjusted under 35 U.S.C. 154(b) by 204 days.

(21) Appl. No.: 12/355,570

(22) Filed: Jan. 16, 2009

(65) Prior Publication Data

US 2009/0139635 A1 Jun. 4, 2009

Related U.S. Application Data

(63) Continuation of application No. PCT/JP2007/063787, filed on Jul. 11, 2007.

(30) Foreign Application Priority Data

Jul. 19, 2006 (JP) ..... 2006-197180

(51) Int. Cl.
*B27M 1/00* (2006.01)

(52) U.S. Cl. ..... 144/380

(58) Field of Classification Search ..... 144/358–360, 144/364, 380; 425/405.1; 428/105, 106, 428/113, 114
See application file for complete search history.

(56) References Cited

U.S. PATENT DOCUMENTS 3,131,034 A * 4/1964 Marsh ..... 34/496
3,521,373 A * 7/1970 Pagnozzi ..... 34/406
5,247,975 A * 9/1993 Tanahashi et al. ..... 144/271
5,343,913 A * 9/1994 Tanahashi et al. ..... 144/380
7,290,576 B2 * 11/2007 Suzuki ..... 144/344
7,296,604 B2 * 11/2007 Suzuki ..... 144/345
7,395,844 B2 * 7/2008 Suzuki ..... 144/361
7,537,619 B2 * 5/2009 Huard ..... 8/402
7,726,367 B2 * 6/2010 Suzuki ..... 144/360
2007/0014972 A1 * 1/2007 Suzuki ..... 428/174
2007/0031693 A1 * 2/2007 Suzuki et al. ..... 428/537.1
2009/0208766 A1 * 8/2009 Suzuki et al. ..... 428/537.1

FOREIGN PATENT DOCUMENTS

JP 04164603 A 6/1992
JP 08-025301 1/1996
JP 11-077619 3/1999
WO WO 03/103911 A1 12/2003

OTHER PUBLICATIONS

Japanese language office action and its English language translation for corresponding Japanese application 2006197180 lists the references above.

* cited by examiner

*Primary Examiner* — Shelley Self
(74) *Attorney, Agent, or Firm* — Hogan Lovells US LLP

(57) ABSTRACT

A method is of processing a wooden piece into a predetermined three dimensional shape by compressing the wooden piece. The method includes compressing a first wooden piece and a second wooden piece in a water vapor atmosphere of a temperature and a pressure higher than a temperature and a pressure of an atmospheric air, by placing the first and the second wooden pieces one on another, the first wooden piece having a shape including a curved surface, and the second wooden piece having a flat board-like shape in which a large part of fiber components run in a direction substantially parallel to a surface.

8 Claims, 9 Drawing Sheets

METHOD OF PROCESSING WOODEN PIECE

CROSS-REFERENCE TO RELATED APPLICATIONS

This application is a continuation of PCT international application Ser. PCT/JP2007/063787 filed Jul. 11, 2007 which designates the United States, incorporated herein by reference, and which claims the benefit of priority from Japanese Patent Application No. 2006-197180, filed Jul. 19, 2006, incorporated herein by reference.

BACKGROUND OF THE INVENTION

1. Field of the Invention

The present invention relates to a method of processing a wooden piece into a predetermined three dimensional shape by compressing the wooden piece.

2. Description of the Related Art

In recent years, wood which is a natural material attracts attention. With a wide variety of grain patterns, wood products exhibit individual features depending on positions of raw wood from which the particular wood products are cut out. In addition, surface flaws and discolorations caused by a long-term use create unique textures which tend to evoke warm and familiar feeling in the user. Thus, the wooden material attracts attention as a material for products of uniqueness and taste which cannot be found in products made of synthetic resin or light metals. Techniques for processing wooden materials are also developing dramatically.

SUMMARY OF THE INVENTION

A method of processing a wooden piece into a predetermined three dimensional shape by compressing the wooden piece according to one aspect of the present invention includes compressing a first wooden piece and a second wooden piece in a water vapor atmosphere of a temperature and a pressure higher than a temperature and a pressure of an atmospheric air, by placing the first and the second wooden pieces one on another, the first wooden piece having a shape including a curved surface, and the second wooden piece having a flat board-like shape in which a large part of fiber components run in a direction substantially parallel to a surface.

The above and other features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments (hereinafter simply referred to as "embodiments") of the present invention will be described below with reference to the accompanying drawings. The drawings to be referred to in the following description are merely schematic, and the dimension and the scale of the same object may be different in different drawings.

Figure 1:
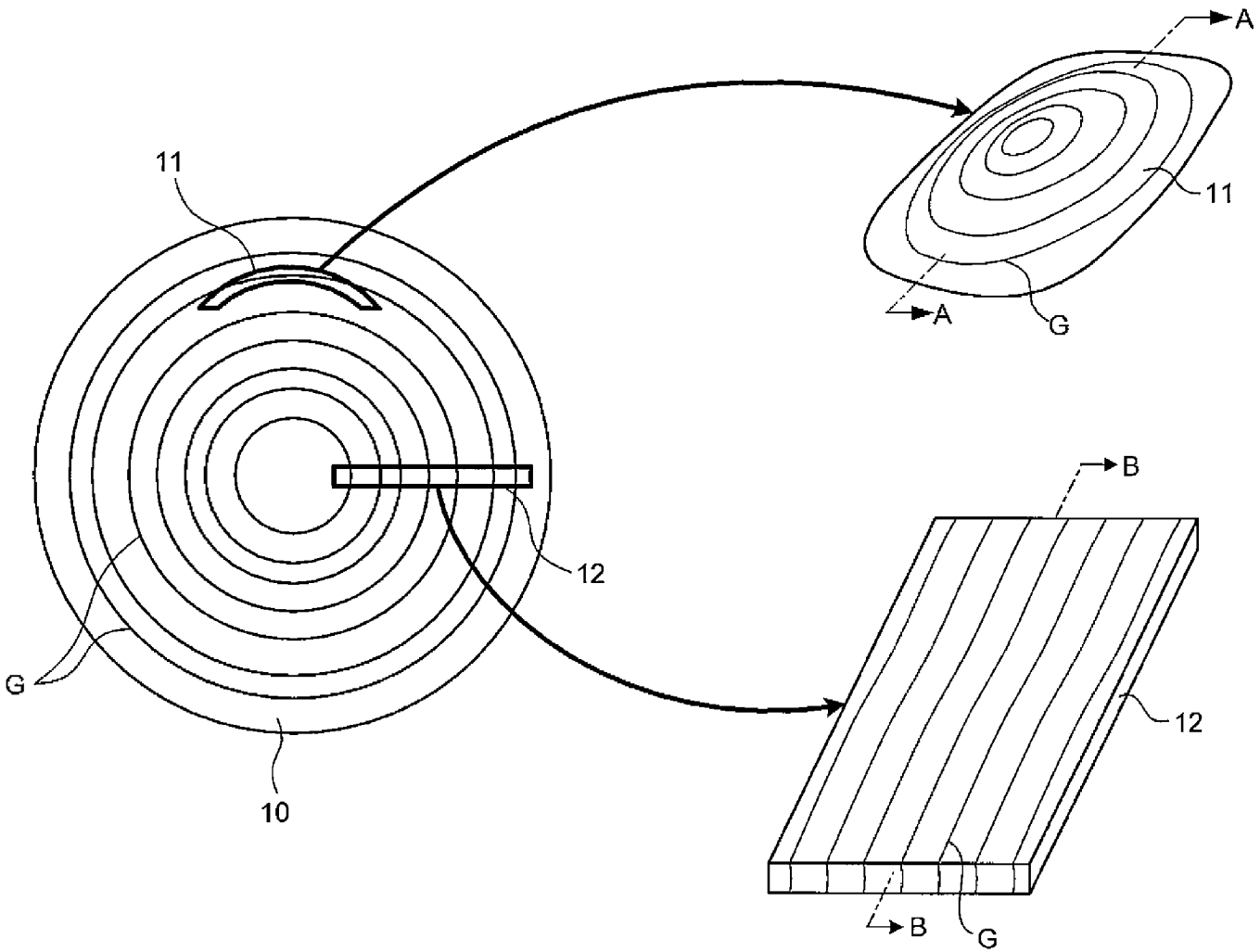
FIG. 1 is a schematic view of an outline of a cutting-out process of a method of processing a wooden piece according to one embodiment of the present invention.

In a method of processing a wooden piece according to one embodiment of the present invention, two wooden pieces of predetermined shapes are first cut out from a raw wood (cutting-out process). FIG. 1 schematically shows an outline of the cutting-out process. In the cutting-out process, a dish-like wooden piece 11 (first wooden piece) and a board-like wooden piece 12 (second wooden piece) are cut out from an uncompressed raw wood 10 (having a grain pattern G) through cutting or the like. The wooden pieces 11 and 12 each have a volume to which an amount to be decreased in a compression process described later is added in advance. Here, "dish-like shape" means a three-dimensional shape with a curved surface in general, such as bowl-like shape, shell-like shape, box-like shape, and boat-like shape.

Figure 2:
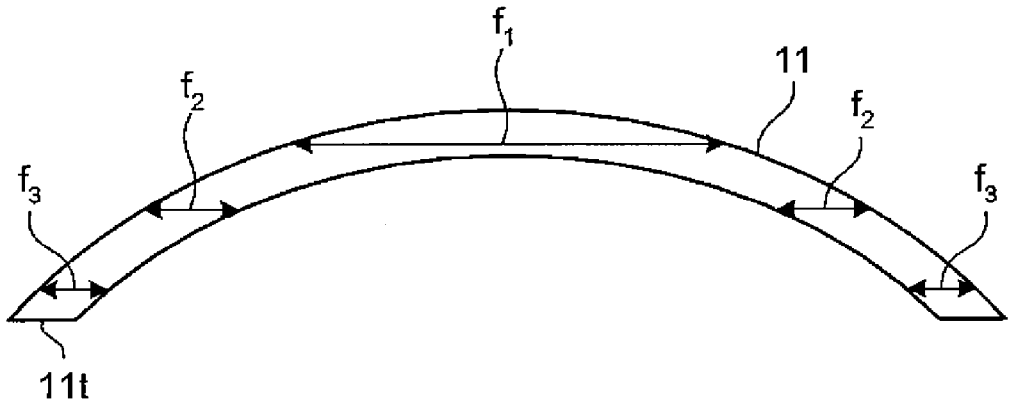
FIG. 2 is a schematic view of fiber components of a first wooden piece.

The wooden piece 11 is a flat-grain piece cut out in such a manner that the curvature of a side surface thereof is generally larger than the curvature of the grain pattern G appears on the side surface, as shown in FIG. 1. FIG. 2 schematically shows a sectional shape of the wooden piece 11 along line A-A, together with fiber components appear on this section. As shown in FIG. 2, the wooden piece 11 has a substantially circular-arc-like, curved sectional shape, and the fiber components appear on this section run in a direction (horizontal direction of FIG. 2) parallel with a tangent line running on a most depressed portion (a central portion in FIG. 2) corresponding to a bottom portion of a dish. Further, the fiber components are shortest near a closed circular end surface 11*t* of the wooden piece 11 (as illustrated by a fiber component $f_3$), and gradually become longer from the end surface 11*t* towards a portion around the bottom portion (portion around the central portion in FIG. 2) of the dish-like wooden piece 11 (as illustrated by a fiber component $f_2$), and are longest near the bottom portion of the dish-like wooden piece 11 (as illustrated by a fiber component $f_1$). Thus, the fiber components of the wooden piece 11 vary in length, and therefore, the strength of the wooden piece 11 varies significantly depending on a position, and is lowest near the end surface 11*t*.

Figure 3:
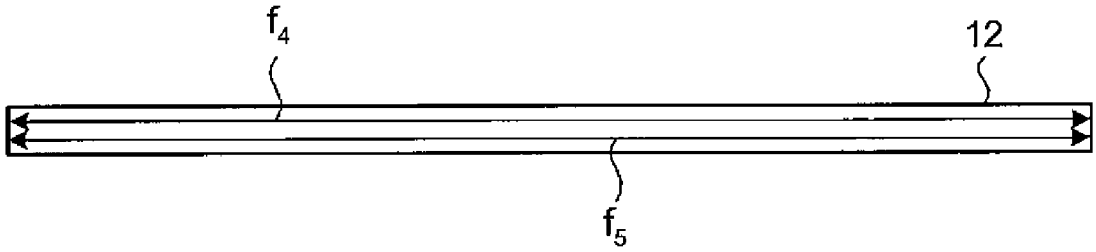
FIG. 3 is a schematic view of fiber components of a second wooden piece.

On the other hand, the wooden piece 12 is a straight-grain piece cut out in such a manner that the grain pattern runs substantially parallel with a lengthwise direction thereof as shown in FIG. 1. FIG. 3 is a schematic view showing a sectional shape of the wooden piece 12 along line B-B together with fiber components appear on this section. As shown in FIG. 3, a large part of the fiber components of the wooden piece 12 runs in a direction substantially parallel with the lengthwise direction of the wooden piece 12 as illustrated by two fiber components $f_4$ and $f_5$ of FIG. 3, and the fiber components have substantially the same length regardless of their positions. Therefore, the strength of the wooden piece 12 is also uniform in the direction in which a large part of the fiber components run regardless of the positions. Further, since the length of each fiber component of the wooden piece 12 is longer than the length of the fiber component of the wooden piece 11, the strength of the wooden piece 12 at least in the direction in which a large part of the fiber components run is higher than the strength of the wooden piece 11 in any direction. Here, "a large part" means a portion which occupies a significantly larger fraction of a whole in comparison with other portions, and occupies at least more than 50% of the whole, or more preferably more than 70 to 80% of the whole.

An area of one surface of the rectangular wooden piece 12 is larger than an area of a plane surrounded by the outer periphery of the end surface 11*t* of the wooden piece 11. Therefore, the end surface 11*t* of the wooden piece 11 can be kept in contact with the surface of the wooden piece 12 during the compression process described later, whereby the end surface 11*t* can be compressed accurately.

The raw wood 10 which is a raw material of the wooden pieces 11 and 12 may be an optimal one selected from Japanese cedar, hiba cedar, *paulownia*, Japanese cypress, pine, cherry, *zelkova*, ebony wood, palisander, bamboo, teak, mahogany, and rosewood depending on the purpose of use and the like of the processed wooden piece. The wooden pieces 11 and 12 may be cut out respectively from different types of the raw wood 10.

The wooden pieces 11 and 12 are then left in a water vapor atmosphere of a temperature and a pressure higher than those of the atmospheric air for a predetermined time period, and sufficiently softened through excessive water absorption (softening process). Here, the high temperature is approximately 100 to 230° C., and preferably approximately 180 to 230° C., and more preferably approximately 180 to 200° C., and the high pressure is approximately 0.1 to 3.0 MPa (megapascal), preferably approximately 0.45 to 2.5 MPa, and more preferably approximately 1.0 to 1.6 MPa. Instead of being left in the water vapor atmosphere as described above for softening, the wooden pieces 11 and 12 may be heated by high-frequency electromagnetic waves such as microwaves for softening.

Figure 4:
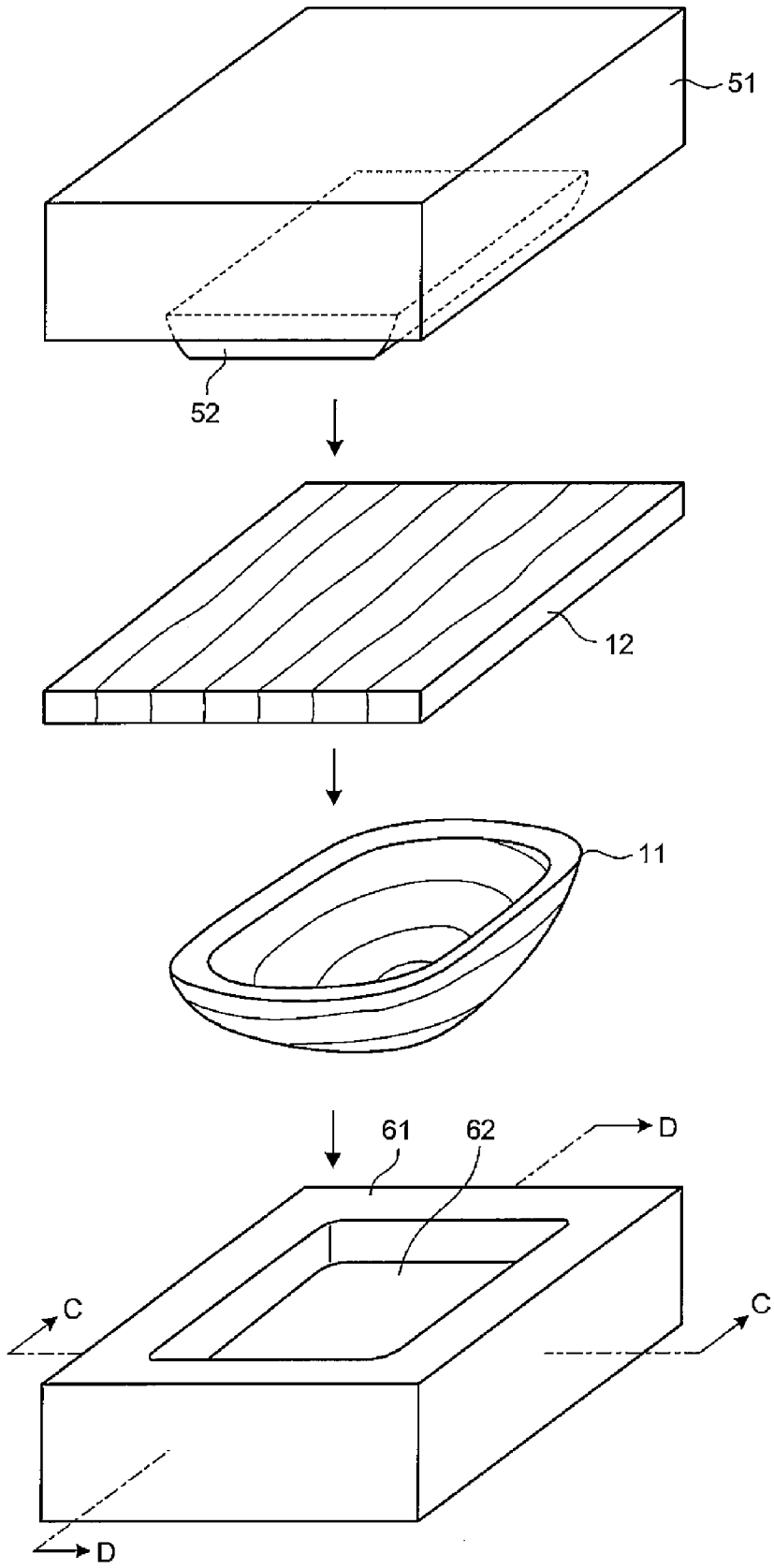
FIG. 4 is a schematic view of the outline of a compression process of the method of processing a wooden piece according to one embodiment of the present invention.

Subsequently, the wooden pieces 11 and 12 sufficiently softened through the softening process described above are compressed (compression process). FIG. 4 is a schematic view of the outline of the compression process. As shown in FIG. 4, when the wooden pieces 11 and 12 are to be compressed, the wooden piece 12 is placed on the wooden piece 11 so that the wooden piece 12 faces a depressed side surface of the wooden piece 11. Then, two wooden pieces 11 and 12 are sandwiched by a pair of metal molds 51 and 61 together, and a predetermined compressive force is applied. In FIG. 4, the metal mold 51 which applies a compressive force to the wooden piece 12 from above is a core metal mold having a protrusion 52 that is brought into contact with a surface of the wooden piece 12. On the other hand, the metal mold 61 which applies a compressive force to the wooden piece 11 from below in FIG. 4 is a cavity metal mold having a depression 62 in which an outer side surface of the wooden piece 11 fits.

In the compression process, the wooden pieces 11 and 12 are compressed in the water vapor atmosphere the same as that in the softening process. Specifically, at least one of the metal molds 51 and 61 is moved toward the other of the metal molds 51 and 61 so as to sandwich the wooden pieces 11 and 12, and to gradually deform the wooden pieces 11 and 12 into a predetermined three dimensional shape. Here, for the convenience of description, a case where the metal mold 51 is lowered down to the metal mold 61 is described.

Figure 5:
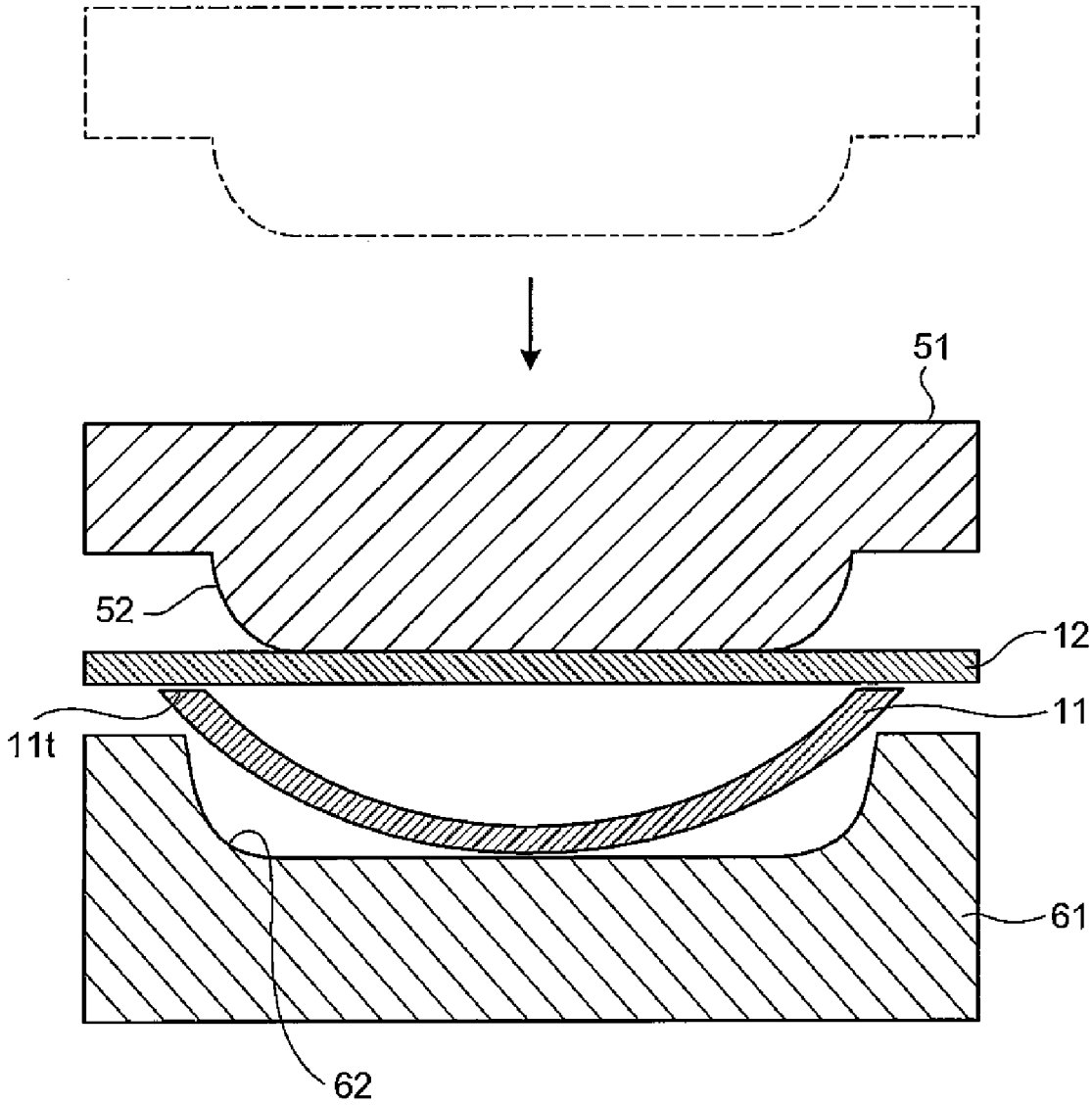
FIG. 5 is a schematic view of a wooden piece starting to be compressed in the compression process of the method of processing a wooden piece according to one embodiment of the present invention.
Figure 6:
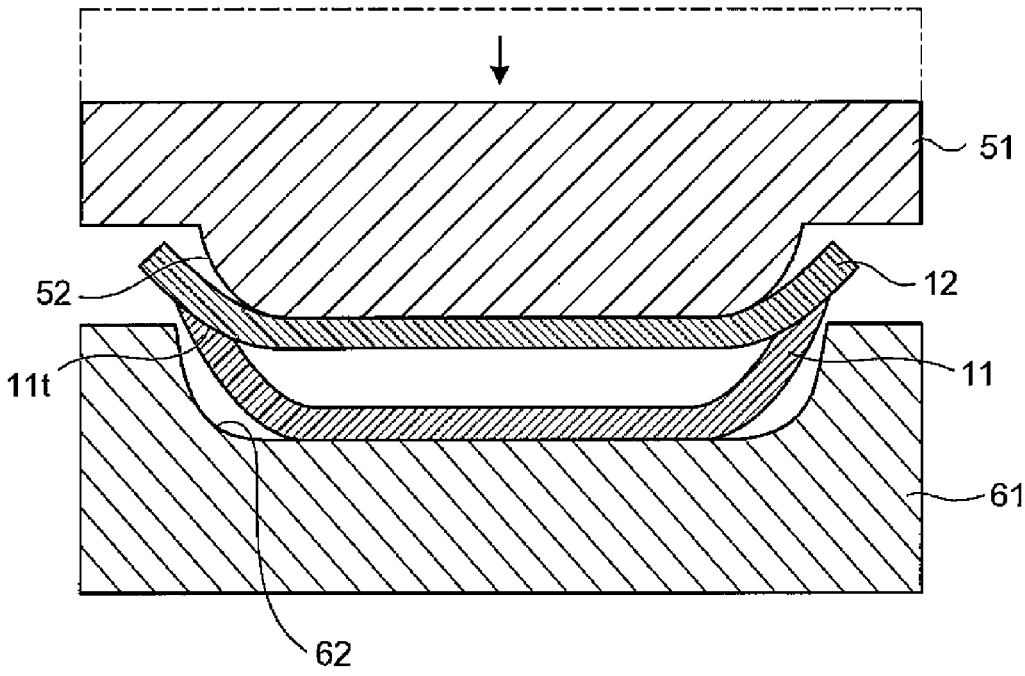
FIG. 6 is a schematic view of a wooden piece deforming in the compression process of the method of processing a wooden piece according to one embodiment of the present invention.

FIG. 5 shows a state where the metal mold 51 starts touching the wooden piece 12, in other words, FIG. 5 shows a state where a compressive force from the metal molds 51 and 61 starts working on the wooden pieces 11 and 12. FIG. 5 shows a vertical section corresponding to a section along line C-C of the wooden pieces 11 and 12 and the metal molds 51 and 61 shown in FIG. 4. Further, FIG. 6 shows a state where the metal mold 51 is further lowered down from the state shown in FIG. 5. If the state shown in FIG. 5 is shown along line D-D of FIG. 4, it appears the same as FIG. 5 except difference in dimension and slight difference in shape. Further, if the state shown in FIG. 6 is shown along line D-D of FIG. 4, it appears the same as FIG. 6 except difference in dimension and slight difference in shape.

During the transition from the state shown in FIG. 5 to the state shown in FIG. 6, an outer side surface of a most depressed portion of the dish-like wooden piece 11 first touches the central portion of the depression 62. Then, the wooden piece 11 gradually deforms while increasing a contact area with the depression 62 from the central portion toward a peripheral portion of the depression 62. On the other hand, during the transition from the state shown in FIG. 5 to the state shown in FIG. 6, the wooden piece 12 deforms so that a portion not in contact with the protrusion 52 (peripheral portion) gradually approaches the protrusion 52 and increases a contact area with the protrusion 52.

The area of one surface of the wooden piece 12 is larger than the area of the plane surrounded by the outer periphery of the end surface 11*t* of the wooden piece 11. Therefore, during the deformation of the wooden piece 11, the end surface 11*t* of the wooden piece 11 constantly receives the compressive force from the wooden piece 12 while sliding against the lower surface of the wooden piece 12. Thus, since the wooden piece 12 constantly presses the end surface 11*t* of the wooden piece 11, the wooden piece 11 is prevented from expanding in a direction perpendicular to the thickness direction thereof during the compression process. Therefore, even when the wooden piece 11 undergoes a significant shape change through the compression process, an excessive tensile force does not work on the wooden piece 11 during the compression, whereby the deformation of the wooden piece 11 can be realized with an appropriate compressive force. As a result, it becomes possible to prevent the generation of cracks or the like in the wooden piece 11 in the compression, and the processing yield of the wooden pieces 11 and 12 can be increased.

Depending on the types of the wooden pieces 11 and 12, the sliding resistance may exceed a tolerable range. In such case, it is possible to apply lubricant such as wax on the end surface 11*t* of the wooden piece 11 and/or the lower surface of the wooden piece 12 so as to decrease the sliding resistance.

Figure 7:
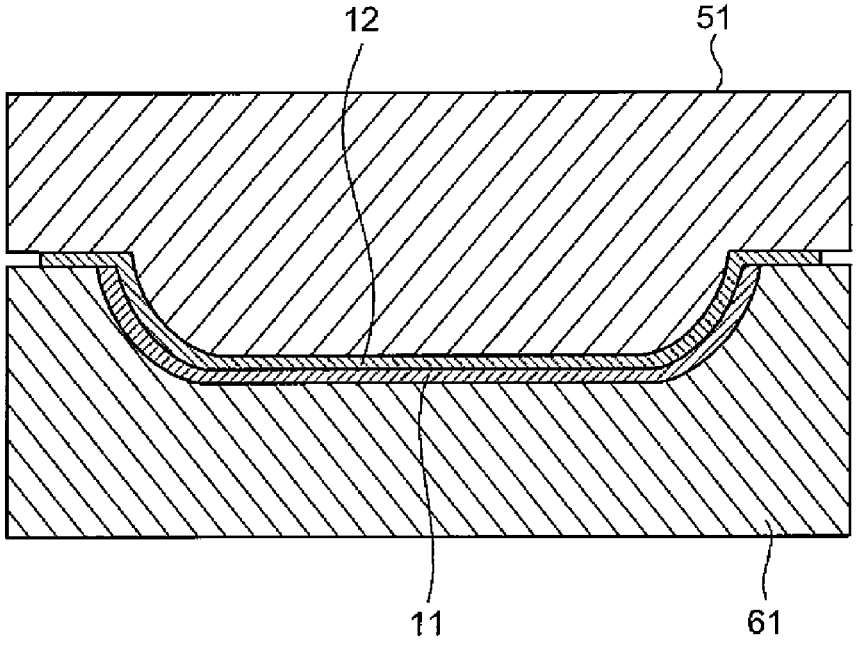
FIG. 7 is a schematic view of a wooden piece whose deformation has nearly finished in the compression process of the method of processing a wooden piece according to one embodiment of the present invention.

The compression process is described next. When the metal mold 51 is further brought closer to the metal mold 61 from the state shown in FIG. 6, the lower surface of the wooden piece 11 comes into close contact with the surface of the depression 62 of the metal mold 61. On the other hand, the upper surface of the wooden piece 12 comes into close contact with the surface of the protrusion 52 of the metal mold 51. FIG. 7 shows this close-contact state. Specifically, FIG. 7 shows a state where the deformation of the wooden pieces 11 and 12 by the compression has nearly finished. As shown in FIG. 7, the wooden pieces 11 and 12 deform into a three dimensional shape corresponding to a gap between the metal molds 51 and 61 by receiving the compressive force from the metal molds 51 and 61. During the process of deformation, the wooden pieces 11 and 12 become one piece as a hard portion of one wooden piece bites into a soft portion of the other wooden piece. Depending on the types and the shapes of the wooden pieces 11 and 12, an appropriate adhesive agent may be applied between the wooden pieces 11 and 12 before the compression process. When the state shown in FIG. 7 is seen in the section along line D-D of FIG. 4, it appears the same as FIG. 7 except difference in dimension and slight difference in shape.

After the compressive force is applied to the wooden pieces 11 and 12 in the state shown in FIG. 7 for a predetermined time period (one to dozens minutes, or more preferably approximately five to ten minutes), the water vapor atmosphere is removed to dry the wooden pieces 11 and 12. Then, the metal molds 51 and 61 are separated from each other, and the wooden pieces 11 and 12 are released from compression. Thickness of each of the wooden pieces 11 and 12 after the compression is approximately 30 to 50% of the thickness before the compression. In other words, a compression rate of the wooden pieces 11 and 12 in the compression process (i.e., ratio $\Delta R/R$ of the decreased thickness $\Delta R$ of the wooden piece in the compression to the thickness R of the wooden piece before the compression) is preferably approximately 0.50 to 0.70.

When at least one of the metal molds 51 and 61 is moved to the other mold, an appropriate driving unit may be employed to electrically move the metal mold 51 and/or the metal mold 61, so as to adjust the compressive force applied to the wooden pieces 11 and 12. Alternatively, the metal molds 51 and 61 may be connected with each other by a screw, so that the vertical movement of the metal mold 51 relative to the metal mold 61 can be realized with manual or automatic fastening of the screw.

After the compression process described above, the combined wooden pieces 11 and 12 are shaped into a predetermined three dimensional shape (shaping process). When the compression process is finished, an edge portion of the wooden piece 12 covers the end surface 11*t* of the wooden piece 11, and further sticks out from the outer periphery of the wooden piece 11 in an outward direction (see FIG. 7). Therefore, in the shaping process, the sticking-out portion is removed by cutting or the like and the wooden pieces 11 and 12 are shaped.

Figure 8:
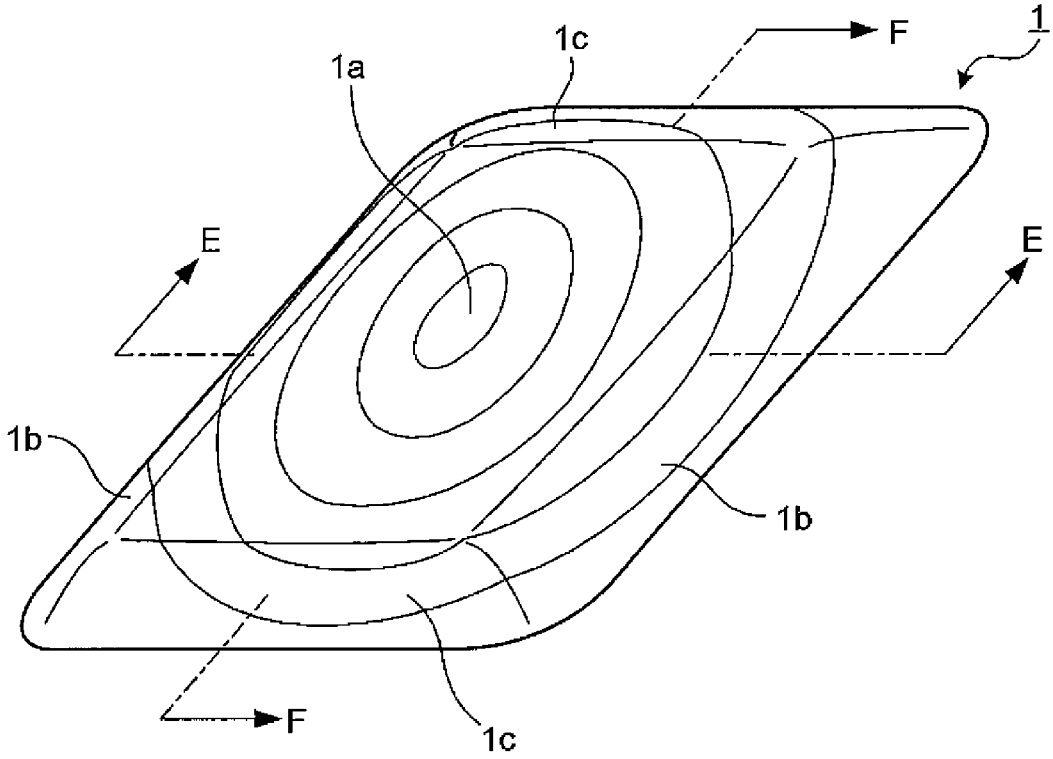
FIG. 8 is a perspective view of a structure of a compressed wood product which is manufactured according to the method of processing a wooden piece according to one embodiment of the present invention.
Figure 9:
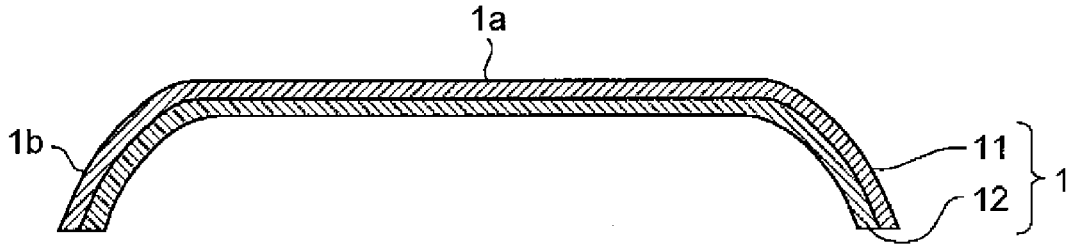
FIG. 9 is a sectional view along line E-E of FIG. 8.

FIG. 8 is a schematic perspective view of a structure of a compressed wood product manufactured according to the method of processing a wooden piece described above. FIG. 9 is a sectional view along line E-E of FIG. 8. A compressed wood product 1 shown in FIGS. 8 and 9 has a dish-like shape with a flat bottom surface. The compressed wood product 1 has a substantially rectangular main plate portion 1*a* as its bottom surface, two side plate portions 1*b* which extend respectively from two sides of the main plate portion 1*a* forming a predetermined angle with the main plate portion 1*a*, the sides being substantially parallel to the lengthwise direction of the surface of the main plate portion 1*a*, and two side plate portions 1*c* which extend respectively from two sides of the main plate portion 1*a* forming a predetermined angle with the main plate portion 1*a*, the sides being substantially parallel to the breadthwise direction of the surface of the main plate portion 1*a*. The thickness of the compressed wood product 1 is substantially uniform. A sectional view along line F-F of FIG. 8 is the same as FIG. 9 (sectional view along line E-E of FIG. 8) except difference in dimension and slight difference in shape and the like.

In the embodiment and the drawings, the thickness of the wooden piece 11 and the thickness of the wooden piece 12 are shown as the same. The relation between the thicknesses of the wooden pieces 11 and 12 is not limited thereto, and can be determined according to the materials and required strengths of the wooden pieces 11 and 12 as appropriate.

Figure 10:
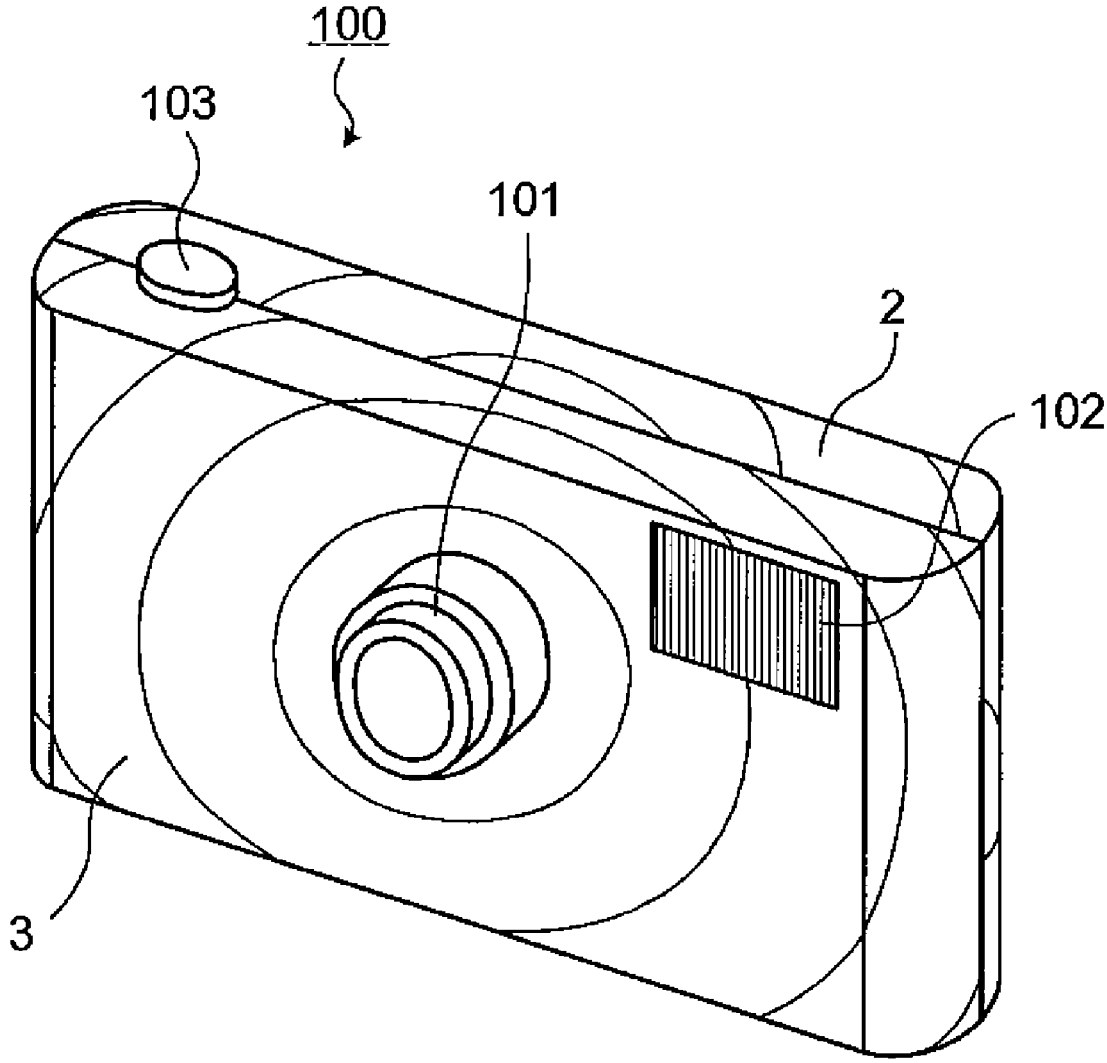
FIG. 10 is a perspective view of an external appearance of a digital camera which is covered with a compressed wood product according to an embodiment of the present invention.

FIG. 10 is a view of one example of application of the compressed wood product 1. Specifically, FIG. 10 is a perspective view of an external structure of a digital camera which is covered by a cover member formed from the compressed wood product 1. A digital camera 100 shown in FIG. 10 includes an imaging unit 101 having an imaging lens, a photoflash 102, and a shutter button 103, and is covered with two cover members 2 and 3. Inside the digital camera 100, various electronic components and optical components (not shown) are housed to realize functions of the digital camera 100. Housed components are, for example, a control circuit that performs drive control related to an imaging process or the like, a solid-state image sensing device such as a charge-coupled device (CCD) and a complementary metal-oxide semiconductor (CMOS), an audio input/output device such as a microphone and a speaker, and a drive circuit that drives each functioning component under the control of the control circuit.

Figure 11:
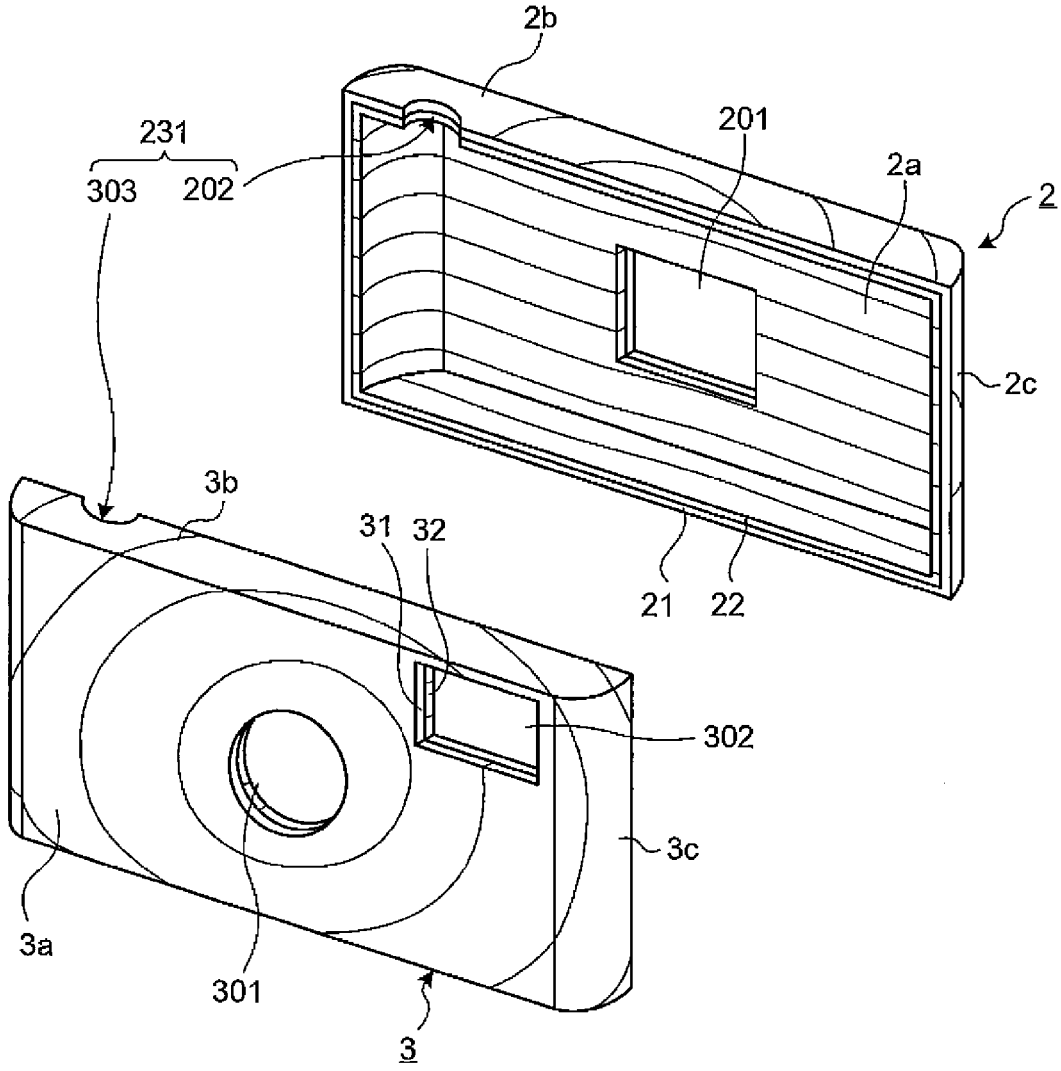
FIG. 11 is a perspective view of a structure of a jacket member of the digital camera shown in FIG. 10.

FIG. 11 is a perspective view of a schematic structure of the cover members 2 and 3 which are jacket members of the digital camera 100. Of these, the cover member 2 which covers a back surface side of the digital camera 100 includes a main plate portion 2*a*, and side plate portions 2*b* and 2*c* corresponding respectively to the main plate portion 1*a*, the side plate portions 1*b* and 1*c* of the compressed wood product 1. In the main plate portion 2*a*, a rectangular opening 201 is formed to expose a display unit (not shown) which is implemented with a liquid crystal display, a plasma display, or an organic EL display to show image information and text information. Further, in the side plate portion 2*b* of the cover member 2, a semi-circular cutout 202 is formed. Of wooden pieces 21 and 22 of the cover member 2, the wooden piece 21 corresponds to the wooden piece 11, and the wooden piece 22 corresponds to the wooden piece 12.

On the other hand, the cover member 3 which covers a front surface side of the digital camera 100 includes a main plate portion 3*a*, and side plate portions 3*b* and 3*c* corresponding respectively to the main plate portion 1*a*, the side plate portions 1*b* and 1*c* of the compressed wood product 1. In the main plate portion 3*a*, a circular opening 301 to expose the imaging unit 101 and a rectangular opening 302 to expose the photoflash 102 are formed. Further, in the side plate portion 3*b* of the cover member 3, a semi-circular cutout 303 which is joined with the cutout 202 of the cover member 2 to form an opening 231 to expose the shutter button 103 is formed. Of wooden pieces 31 and 32 of the cover member 3, the wooden piece 31 corresponds to the wooden piece 11, and the wooden piece 32 corresponds to the wooden piece 12.

The openings and the cutouts of the cover members 2 and 3 may be formed in the shaping process described above through cutting, drilling, or the like. Further, additional openings and cutouts may be formed for an attachment of a finder, or to expose buttons for manual input of instructions. Further, an additional opening may be formed to expose a connection interface (such as a DC input terminal and a USB connection terminal) for an external device. Further, holes for audio output may be formed, for example, as plural small holes so that sound generated by a speaker provided inside the digital camera can be output to the outside.

An electronic device to which the compressed wood product 1 can be applied as a jacket member includes, other than the digital camera 100, various portable communication terminals such as a cellular phone, a personal handy-phone system (PHS), and a personal data assistant (PDA), a portable audio system, an IC recorder, a portable television, a portable radio, a remote control of various consumer electronics, and a digital video. Preferably, when applied to these small portable electronic devices, the compressed wood product 1 is approximately 1.6 to 2.0 mm in thickness.

According to the embodiment of the present invention as described above, a method of processing a wooden piece can be provided. According to this method of processing a wooden piece, the first wooden piece has a shape including a curved surface and the second wooden piece has a board-like shape in which a large part of the fiber components runs in the direction substantially parallel to the surface, and the first wooden piece and the second wooden piece are placed one on another and compressed in the water vapor atmosphere of a temperature and a pressure higher than those of the atmospheric air, whereby a wide variety of grain pattern, easy forming, and increased strength can be realized.

Further, according to the embodiment, the board-like second wooden piece is placed on the dish-like first wooden piece so that the second wooden piece faces the depressed side surface of the first wooden piece, and the first and the second wooden pieces are compressed together, whereby the second wooden piece serves as a backing member of the first wooden piece, and the first wooden piece with an insufficient strength can be properly reinforced by the second wooden piece.

Further, according to the embodiment, the area of a plane surrounded by the outer periphery of the circular closed end surface of the dish-like first wooden piece is made smaller than the area of one surface of the second wooden piece, whereby the first and the second wooden pieces can be compressed while kept in the state where the one surface of the second wooden piece is in contact with the end surface of the first wooden piece. Thus, the generation of cracks or the like in the first wooden piece can be prevented, and the easy forming and increased yield can be realized.

Figure 12:
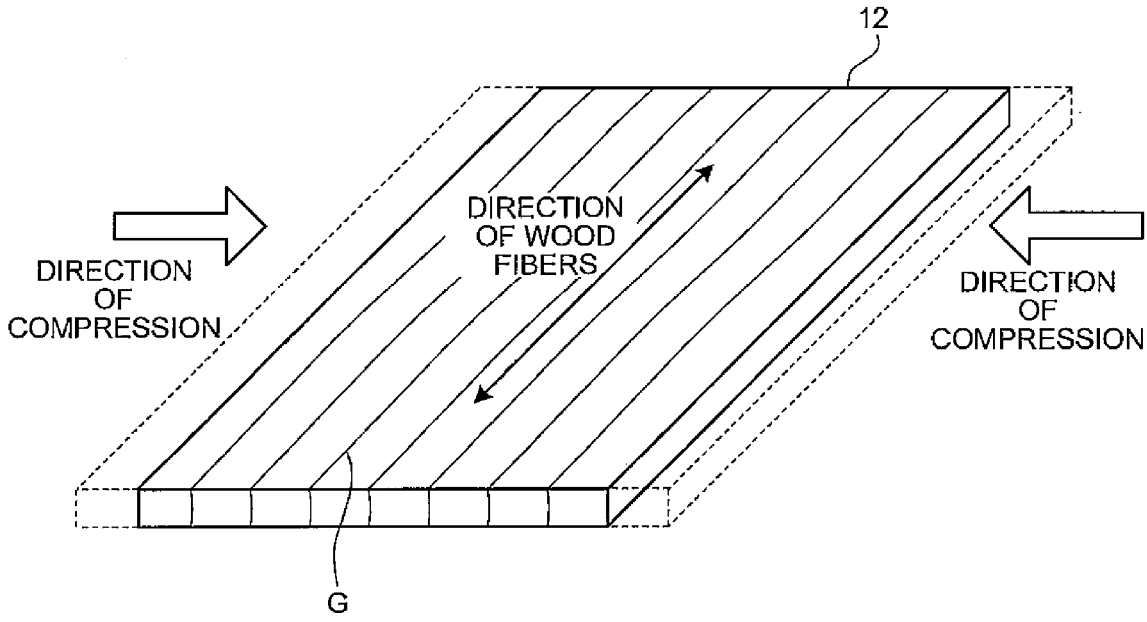
FIG. 12 is a schematic view of an outline of a pre-compression process which is performed as a deformation process on a second wooden piece.

The embodiment of the present invention has been described above. The present invention, however, is not limited only to the embodiment described above. For example, when the board-like second wooden piece has a straight-grain pattern, the second wooden piece after the softening in the softening process may be deformed before the compression process by the application of a compressive force in a direction substantially perpendicular to the direction of the fiber components of the second wooden piece in the same water vapor atmosphere as that in the softening process. FIG. 12 is a schematic view of an outline of a pre-compression process which is an example of the deformation process of the wooden piece 12 which is the second wooden piece. A large part of the fiber components of the wooden piece 12 runs in a direction parallel to the lengthwise direction thereof. Therefore, the compressive force is applied in a direction substantially perpendicular to the direction in which the large part of the fiber components of the wooden piece 12 runs, i.e., a direction parallel to the breadthwise direction of the wooden piece 12, so that the interval between the fibers is shortened.

When the wooden piece 12 is placed over the wooden piece 11 (first wooden piece) for the compression process after the pre-compression process described above, the wooden piece 12 naturally expands in the breadthwise direction so as to recover the original interval between the fibers. Therefore, the sliding resistance can be reduced when the end surface 11*t* of the wooden piece 11 slides against the lower surface of the wooden piece 12 shown, for example, in FIG. 5. Thus, the end surface 11*t* of the wooden piece 11 can slide against the lower surface of the wooden piece 12 more smoothly at the time of deformation. Thus, the pre-compression is preferable also for the prevention of crack generation in the wooden pieces 11 and 12 at the time of compression.

Further, when the wooden piece 12 behaves to expand back to the original shape because of the pre-compression process described above, such behavior of the wooden piece 12 naturally absorbs a large tensile stress acting on a portion, which deforms into an outer curved surface, of the wooden piece 12 when the wooden piece 12 deforms in conformity with the surface shapes of the metal molds 51 and 61 during the compression process. Therefore, the excessive tensile stress does not work on this portion of the wooden piece 12, whereby the generation of cracks in the wooden piece 12 can be prevented.

Further, in the pre-compression process, instead of cutting out the wooden piece 12 from the raw wood 10, a long, flat board including the wooden piece 12 may be cut out. In this case, after the softening process and the pre-compression process, the long, flat board may be cut and plural wooden pieces 12 may be formed.

Further, in the present invention, if it is difficult to deform the second wooden piece in a flat board state into a predetermined three dimensional shape only through the compression process, it is possible to deform the second wooden piece into a predetermined shape in the water vapor atmosphere the same as that in the softening process, and place the deformed second wooden piece on the first wooden piece to perform the compression process (second example of the deformation process). In the deformation of the second wooden piece, a compressive force may be applied to the second wooden piece. Alternatively, deformation alone may be performed without the application of a compressive force. Further, in the deformation of the second wooden piece, a metal mold may be used, or alternatively, other appropriate jig may be used.

Further, the first wooden piece applied in the present invention may have a grain pattern other than the flat-grain pattern. For example, the first wooden piece may have a straight-grain pattern, an intermediate grain pattern between the straight-grain and the flat-grain, or an end-grain pattern. On the other hand, a wooden piece with a flat-grain pattern in which the fiber components run along the surface may be employed as the second wooden piece. Further, the surface of the first wooden piece may not be rectangular like the wooden piece 11. The outer circumference of the surface of the first wooden piece may draw a curve like an oval. Thus, a manner of cutting out a wooden piece to be processed from a raw wood in the present invention may be determined according to the purpose of use of the compressed wood product which is obtained as a result of processing of the wooden piece, required strength of the compressed wood product, or a grain pattern desired in the compressed wood product.

Further, in the present invention, a surface of at least one of the first and the second wooden pieces opposing to the other wooden piece may be carbonized. Such treatment is more preferable since a conductive layer can be formed in the compressed wood product, and when the compressed wood product is applied as the jacket member of the electronic device, a function of preventing electromagnetic waves can be given to the jacket member of an electronic device without any influence on the appearance.

Further, in the present invention, rather than being formed from one wooden piece, each of the first and the second wooden pieces may be formed from plural wooden pieces. In particular, if the second wooden piece is formed from plural wooden pieces, it is possible to equalize the strength of the second wooden piece by stacking the plural wooden pieces one on another so that the fiber directions of different wooden pieces intersect with each other. Then the reinforcing effect can be enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of processing a wooden piece into a predetermined three dimensional shape by compressing the wooden piece, comprising:

compressing a first wooden piece and a second wooden piece in a water vapor atmosphere of a temperature and a pressure higher than those of an atmospheric air, by placing the first and the second wooden pieces one on another, the first wooden piece having a shape including a curved surface, and wherein the second wooden piece is a flat board in which a large part of fiber components of the second wooden piece run in a direction substantially parallel to a surface of the second wooden piece.

2. The method of processing a wooden piece according to claim 1, further comprising deforming the second wooden piece in the water vapor atmosphere before the compressing.

3. The method of processing a wooden piece according to claim 2, wherein the deforming includes applying a compressive force to the second wooden piece in a direction which is perpendicular to a thickness of the second wooden piece and substantially perpendicular to the direction in which the large part of the fiber components contained in the second wooden piece run.

4. The method of processing a wooden piece according to claim 1, wherein the second wooden piece has a straight-grain pattern.

5. The method of processing a wooden piece according to claim 1, wherein the second wooden piece has a flat-grain pattern.

6. The method of processing a wooden piece according to claim 1, wherein the first wooden piece is a dish having a circular closed end surface, and the compressing includes placing the second wooden piece on the first wooden piece so that the second wooden piece faces a depressed surface of the surfaces of the dish first wooden piece on compression.

7. The method of processing a wooden piece according to claim 6, wherein an area of a plane surrounded by an outer periphery of the end surface of the first wooden piece is smaller than an area of one surface of the second wooden piece.

8. The method of processing a wooden piece according to claim 1, wherein the second wooden piece is formed from plural wooden pieces.

* * * * *